US005286031A

United States Patent [19]

Walker, Jr.

[11] Patent Number: 5,286,031

[45] Date of Patent: Feb. 15, 1994

[54] WAIST MOUNTED TETHERED BALL AND TARGET

[76] Inventor: Wilmer D. Walker, Jr., 1316 Sharon St., N.W., Atlanta, Ga. 30314

[21] Appl. No.: 3,750

[22] Filed: Jan. 13, 1993

Related U.S. Application Data

[63] Continuation-in-part of Ser. No. 792,076, Nov. 7, 1992.

[51] Int. Cl.[5] ..... A63B 67/10

[52] U.S. Cl. ..... 273/320; 273/414; 273/DIG. 19

[58] Field of Search ..... 273/319, 320, 321, 329, 273/330, 331, 333, 334, 335, 398, 399, 400, 401, 402, 412, 413, 414, DIG. 19, 58 C

[56] References Cited

U.S. PATENT DOCUMENTS

| | | | |
|---|---|---|---|
| 2,089,652 | 8/1937 | Kelly | 273/335 |
| 2,480,264 | 8/1949 | Regenold | 273/328 |
| 3,078,099 | 2/1963 | Hyman | 273/328 |
| 3,610,622 | 10/1971 | Haroski | 273/414 X |
| 3,774,910 | 11/1973 | Walker, Jr. | 273/414 X |
| 3,936,051 | 2/1976 | Walker, Jr. | 273/414 X |
| 4,000,898 | 1/1977 | Cooter | 273/325 |

*Primary Examiner*—William H. Grieb
*Attorney, Agent, or Firm*—James B. Middleton

[57] ABSTRACT

A game device has a target plate fixed to the waist area of a person who will play the game, and a ball tethered to the target plate. The tether is flexible to allow the ball to engage a target on the target plate. To facilitate control of the ball on the tether, the tether has a rigid rod flexibly fixed to the bottom of the target plate, and a flexible string extending from the rod to the ball. There are sights between the targets on the target plate. By swinging the tethered ball with the tether aligned with a sight, the player can align the ball to be received by a target. Baskets in the targets catch the balls so the ball can be easily removed from the target.

7 Claims, 1 Drawing Sheet

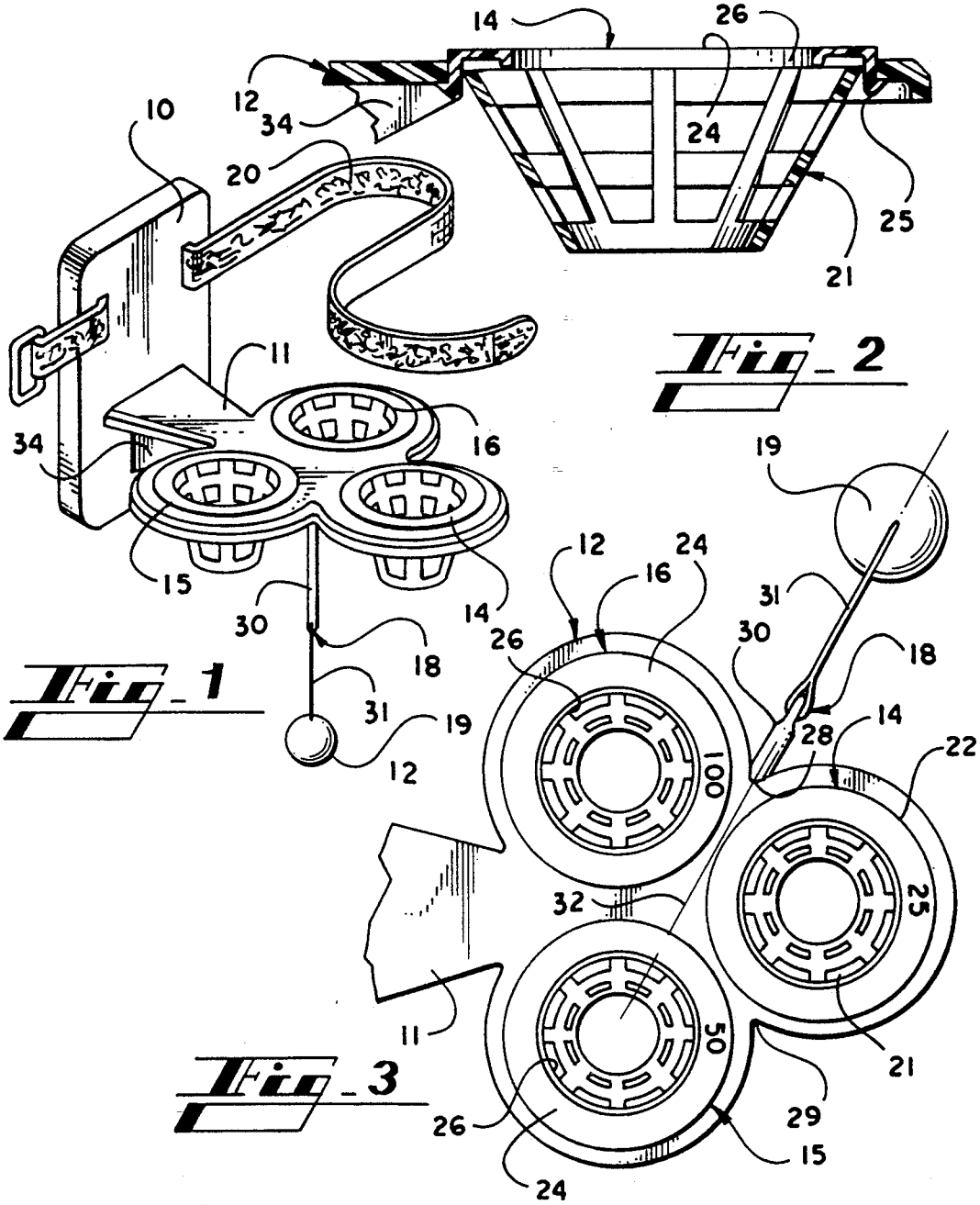
Fig_2
Fig_1
Fig_3
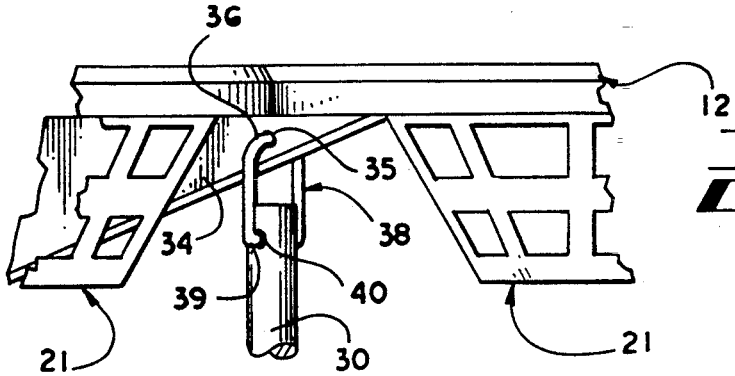
Fig_4

WAIST MOUNTED TETHERED BALL AND TARGET

CROSS-REFERENCE TO RELATED APPLICATION

This application is a continuation in part of the application by the same inventor, titled "Game Pieces for Ball and Cup Game", filed Nov. 7, 1992, under Ser. No. 792,076.

BACKGROUND OF THE INVENTION

1. Field of the Invention

This invention relates generally to recreational games, and is more particularly concerned with a waist mounted game having a tethered ball to be received by a target.

2. Discussion of the Prior Art

There are several prior art games wherein a tethered ball is manipulated by the body to engage a target. One prior art game is disclosed in U.S. Pat. No. 3,774,910 which issued to the inventor of the present invention, and the disclosure is incorporated herein by reference. The present invention is related to, and constitutes an improvement over, the game disclosed in the above mentioned patent. The prior device includes a target plate comprising a plurality of holes for selectively receiving a ball. The ball may be tethered to a member carried by the body of a different person; however, it is also suggested that the ball may be tethered to the target plate, so one person can play the game.

In Pat. No. 3,774,910 (the '910 patent) the tether for the ball is a member that is flexible throughout its length, so it is quite difficult to control the ball, and there are no visual cues to assist a player in causing the ball to be received by the intended target. The game disclosed in the '910 patent is therefore very difficult, and success tends to be more related to probability than to skill or attention by the player.

SUMMARY OF THE INVENTION

The present invention provides a waist mounted game having a target plate, and a ball tethered to the target plate. The target plate includes at least one target for receiving the ball. The tether for the ball includes a first length that is generally rigid, and a second length that is flexible. The first length acts as a control means for directing the ball, and the second length allows freedom for the ball to engage a target on the target plate, or not. The target plate also includes sighting means for cooperation with the first length of the tether. By utilizing the sighting means for directing the motion of the first length of the tether, one can increase the probability of having the ball received by a target on the target plate.

In the preferred embodiment of the invention, the target plate includes a plurality of holes, each hole being of a different diameter for presenting a different level of difficulty in receiving the ball, and there are sighting means between adjacent holes. Further, in one form of the game, the holes of the target plate have baskets to receive the ball so the ball is easily removable therefrom.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a tethered ball and target made in accordance with the present invention;

FIG. 2 is an enlarged cross-sectional view taken through one of the targets on the target plate of the device shown in FIG. 1;

FIG. 3 is an enlarged top plan view of the target plate shown in FIG. 1, and showing the tether and ball in the desired position for scoring; and, FIG. 4 is a fragmentary view showing the connection of the tether to the target plate.

DETAILED DESCRIPTION OF THE EMBODIMENT

Referring now more particularly to the drawings, and to that embodiment of the invention here presented by way of illustration, FIG. 1 illustrates a device made in accordance with the present invention. As shown in FIG. 1, the game device includes a base board 10 having a stem 11 extending therefrom and carrying the target means generally designated at 12. As here shown, the target means 12 includes three targets designated at 14, 15 and 16. A tether 18 depends from the target plate 12, the tether member 18 carrying a ball 19 at its extending end.

Those skilled in the art will realize that, from looking at the '910 patent, the base board 10 will be placed against the waist, or abdominal area, of a player, and fixed thereto by means of a strap 20. The stem 11 will then project away from the body of the person, carrying the target means 12 at the end of the stem 11. The ball 19 hangs below the target means 12, and the object of the game is for the player to manipulate his body in such a way as to cause the ball 19 to be received by one of the targets 14, 15 and 16 on the target plate 12. In the device disclosed in the '910 patent, it will be realized that the entire tether is a flexible member so that the player has no real control of the motion of the ball 19. Also, in the device disclosed in the '910 patent, when the ball is received by one of the targets, or holes, of the target plate, the ball falls completely through the hole, and must be retrieved by pulling the string to cause the ball to pass through the hole, or physically grasping the ball and urging it back through the hole of the target plate.

In the present invention, one of the objects of the invention is to provide control means for allowing the player to direct the motion of the ball 19 for more easily causing the ball 19 to be received by one of the targets on the target plate 12. Also, it is contemplated that the game of the present invention will be played without the use of the player's hands. As a result, baskets or other receiving means are placed within the targets 14, 15 and 16 so the ball will not pass completely through a hole, and will not require the use of hands to remove the ball from the target.

Attention is now directed to FIG. 2 of the drawings which is an enlarged cross-sectional view taken through the target 14 of the target plate 12. In FIG. 2 it will be seen that there is a frustoconical basket designated at 21, the larger end of the basket 21 being received within the opening 22 of the target means 12. A ring 24 secures the basket means 21 to the target plate 12, the ring 24 being secured to the target plate 12 by means of a plurality of hooks 25.

With attention to both FIG. 1 and FIG. 2 of the drawings, it will be understood that all the holes 22 in the target plate 12 are the same size for the targets 14, 15 and 16. The ring 24, however, has different sizes of central openings for the three targets 14, 15 and 16. The central opening 26 shown in FIG. 2 of the drawings is the largest of the targets 14, 15 and 16. The rings 24 for holes 15 and 16 have smaller central openings 26.

With the basket arrangement as described, and as shown in FIG. 2 of the drawings, it will be readily understood that the ball 19 can be received through the central opening 26, and will be received by the basket means 21. The lower end of the basket means 21 is considerably smaller than the ball 19, so the ball 19 will be held by the basket 21.

Looking next at FIG. 3 of the drawings, the differences in the sizes of the openings 26 in the rings 24 can be clearly seen since the openings 26 are shown in their true shape. Also, the tether 18 is shown, moved angularly from its vertical position illustrated in FIG. 1. In FIG. 3, it will be noted that there are sighting means designated at 28 and 29. The sighting means 28 and 29 will be discussed in more detail below.

Considering both FIG. 1 and FIG. 2, it will be noted that the tether 18 includes a first length 30 comprising a generally rigid member. The length 30 is made of a rod-like material that is suspended from the target plate 12. As illustrated in FIG. 1 the length 30 extends generally vertically downwardly, and is connected to a second length 31. The length 31 comprises a string or the like that is completely flexible throughout its length.

Returning to FIG. 3 of the drawings, it will be understood that the player of the game will manipulate his body so that the tether 18 begins to swing. As the tether swings, the player will look downwardly on the target plate 12, and view the tether 18 through the sight (for example) 28. Further, considering FIG. 3 of the drawings, it will be noted that there is a centerline 32 that extends generally from the center of the target 15, along the centerline of the length 30, and along the center of the length 31 of the tether 18. As a result, by swinging the tether so that the centerline of the tether 18 is aligned with the centerline 32, the ball 19 is in position to move into the target 15 of the target plate 12.

Those skilled in the art will realize that, by reversing the body motion, the tether 18 will swing in the opposite direction and be aligned with the sighting means 29. Such action will align the ball 19 to be received by the target 16.

Looking now at FIG. 4 of the drawings, it will be understood that the tether 18 must be suspended from the target means 12 in such fashion that the tether 18 can move in any direction. Those skilled in the art will devise numerous mechanical arrangements for providing such motion, but one very simple and effective mechanical arrangement is illustrated in FIG. 4 of the drawings. It will be seen that there is a supporting web 34 that extends between the target plate 12 and the base board 10. Generally centrally of the target means 12 the web 34 is provided with a hole 35. The hole 35 receives the curved portion 36 of a D-ring generally designated at 38. The straight portion 39 of the D-ring 38 extends through a hole 40 in the length 30 of the tether 18.

With the above described construction, it will be readily understood that the tether 18 can swing in one direction, and the curved portion 36 of the D-ring 38 will move back and forth through the hole 35 in the web 34. The tether 18 can in the opposite direction both by pivoting about the straight portion 39 of the D-ring 38, and by having the D-ring 38 pivot within the hole 35. It will therefore be readily understood that the combination of these motions provides a universal joint for connection of the tether 18 to the web 34.

In view of the above and foregoing discussion, it should now be understood that the device of the present invention provides a game wherein one player can attempt to manipulate the target plate 12 and the attached tether 18 to cause the ball 19 to be received by one of the targets on the target plate 12. It is contemplated that the individual targets 14, 15 and 16 in the target plate 12 will be of different colors, and preferably labeled with a particular number to indicate the points allotted for having the ball 19 received by that particular target. As herein indicated, the points are 25 points for the hole 14, 50 points for the hole 15 and 100 points for the hole 16. Thus, an individual can play alone and keep score in an effort for self improvement. Alternatively, two or more people can play the game in competitive fashion, the one receiving more points in a given length of time being declared the winner.

Further, there are many variations that can be made in playing the game of the present invention. One might play simply for the greatest number of points in a given time period, or one might require that the ball 19 be received by the targets 14, 15, and 16 in a particular sequence. In the latter form of the game, by way of example, one will be required to place the ball 19 in the target 14 first, then to place to place the ball 19 in the target 15, and subsequently in the target 16. With this set of rules, if the ball is first placed in the target 16, the score will not count and the player will still have to place the ball 19 in the target 14. Many other variation will suggest themselves to those skilled in the art.

It will therefore be understood by those skilled in the art that the device of the present invention provides a tethered ball and target game wherein the player is provided with means for controlling the tethered ball for greater assurance in causing the ball to be received by the target. Control means in the present invention is made up of the generally rigid length 30 of the tether member 18 in conjunction with the flexible length 31 of the tether member 18. Also, it will be noted that the sides of the baskets 21 are sloped, and the length 30 must be generally between two baskets as is best shown in FIG. 3. As a result, the sides of the baskets 21 will tend to funnel the member 30 into the proper area to be aligned with the sighting means 28.

When the tether 18 swings forward enough that the generally rigid length 30 substantially engages the bottom surface of the target plate 12, the ball 19 will continue to move up and towards the holes in the target plate 12. To provide the greatest assurance of receiving the ball 19 within a target of the target plate 12, it will be understood that the flexible length 31 of the tether 18 is of such a length that the ball 19 can be just received by the target 15 when the length 30 is positioned as shown in FIG. 3 of the drawings. If the length of the tether 31 allows the ball 19 to go beyond the target 15, one has a greater chance of missing the target 15; and, if the length 31 is too short to allow the ball 19 to reach the target 15, it will of course be understood that the ball 19 can never be received by the target 15.

The foregoing describes the ratio of the length 30 to the length 31, but it will be understood that great variety is allowed in the total length of the tether 18. The primary limitation is that the total length 18 should be such that the ball 19 will not engage the ground when the base board 10 is appropriately placed on the player. As a result, a very tall player can utilize a very long tether 18, while a very short player will require a short tether 18. Regardless of the total length of the tether 18, the relative lengths of the lengths 30 and 31 must be such that the ball 19 can be received within the opposite target of the target plate 12 when the length 30 is placed against the sighting means as illustrated in FIG. 3 of the drawings.

It will therefore be understood that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. In a game device comprising a target plate, at least one target carried by said target plate, a ball, a tether attaching said ball to said target plate, said tether being sufficiently flexible that said ball can be received by said at least one target, the improvement wherein said tether includes a first length that is generally rigid and a second length that is flexible throughout its length, said first length having a first end that is flexibly fixed to said target plate for allowing universal movement of said first length with respect to said target plate, and a second end opposite from said first end, said second length being fixed to said second end of said first length.

2. In a game device as claimed in claim 1, the further improvement wherein said at least one target comprises a plurality of targets, and including sighting means on said target plate for aligning said tether with one of said targets.

3. In a game device as claimed in claim 2, the improvement wherein said first length of said tether is long enough to extend from its attachment to said sighting means, and said second length of said tether is long enough to extend from said first length to one of said targets aligned with said tether.

4. In a game device as claimed in claim 3, each target of said plurality of targets including a frustoconical basket having a top opening and a bottom opening, said top opening being sized to receive said ball therein, said bottom opening being smaller than said ball for retaining said ball within said basket.

5. In a game device as claimed in claim 4, a base board, strap means for attaching said base board generally to the waist of a player, and a stem extending from said base board and carrying said target plate.

6. In a game device as claimed in claim 5, the further improvement wherein said first length of said tether is fixed to said target plate along a line extending from the center of one target and through said sighting means.

7. In a game device as claimed in claim 6, each target of said plurality of targets including a ring having a central opening, said central opening being of a different size for each target.

* * * * *